US006316393B1

(12) United States Patent
Thomas et al.

(10) Patent No.: US 6,316,393 B1
(45) Date of Patent: Nov. 13, 2001

(54) MODIFIED LUBRICATED FERROUS POWDER COMPOSITIONS FOR COLD AND WARM PRESSING APPLICATIONS

(75) Inventors: Yannig Thomas, Montreal; Linda Tremblay, Ste Julie; Sylvain St-Laurent, Repentigny, all of (CA)

(73) Assignee: National Research Council of Canada, Ottawa (CA)

( * ) Notice: Subject to any disclaimer, the term of this patent is extended or adjusted under 35 U.S.C. 154(b) by 0 days.

(21) Appl. No.: 09/676,774

(22) Filed: Oct. 2, 2000

Related U.S. Application Data

(63) Continuation-in-part of application No. 09/186,196, filed on Nov. 4, 1998, now Pat. No. 6,140,278.

(51) Int. Cl.[7] ..... C10M 107/02
(52) U.S. Cl. ..... 508/312; 508/150; 585/2
(58) Field of Search ..... 508/312, 150; 585/2

(56) References Cited

U.S. PATENT DOCUMENTS

| | | | | |
|---|---|---|---|---|
| 4,203,880 | * | 5/1980 | Stoloff et al. | 525/214 |
| 4,239,632 | * | 12/1980 | Baile | 585/10 |
| 5,426,144 | * | 6/1995 | Lindner et al. | 524/399 |
| 5,523,006 | * | 6/1996 | Strumban | 508/150 |
| 5,663,124 | * | 9/1997 | Rao et al. | 508/150 |
| 5,863,870 | * | 1/1999 | Rao et al. | 508/150 |
| 5,985,964 | * | 11/1999 | Herbst et al. | 524/114 |
| 6,013,734 | * | 1/2000 | Berta | 525/221 |
| 6,060,550 | * | 5/2000 | Simon et al. | 524/489 |
| 6,140,278 | * | 10/2000 | Thomas et al. | 508/150 |

* cited by examiner

*Primary Examiner*—Jacqueline V. Howard
(74) *Attorney, Agent, or Firm*—Marks & Clerk

(57) ABSTRACT

Metal powder compositions for powder metallurgy (P/M) applications contain an oxidized high-density polyethylene as a lubricant. The compositions are suitable for either cold or warm compaction. When compacted, the compositions yield parts having relatively high density, high green strength and good surface finish.

19 Claims, 11 Drawing Sheets

MODIFIED LUBRICATED FERROUS POWDER COMPOSITIONS FOR COLD AND WARM PRESSING APPLICATIONS

CONTINUING DATA

The present Application is a Continuation-In-Part of U.S. Ser. No. 09/186,196 filed Nov. 4, 1998 now U.S. Pat. No. 6,140,278.

FIELD OF THE INVENTION

The present invention relates to a lubricant for metal powder compositions, as well as metal powder compositions containing the lubricant effective for either cold or warm compaction. The invention also relates to a method of fabricating pressed and sintered parts from such compositions by cold or warm compaction. More particularly, the invention concerns lubricated powder compositions which, when compacted, yield parts having relatively high density, high green strength and good surface finish.

BACKGROUND OF THE INVENTION

Processes for producing metal parts from ferrous powders using powder metallurgy (P/M) techniques are well known. Such techniques typically involute mixing of ferrous powders with alloying components such as graphite, copper or nickel in powder form, filling the die with the powder mixture, compacting and shaping of the compact by the application of pressure, and ejecting the compact from the die. The compact is then sintered wherein metallurgical bonds are developed by mass transfer under the influence of heat. The presence of an alloying element enhancers the strength and other mechanical properties in the sintered part compared to the ferrous powders alone. When necessary, secondary operations such as sizing, coining, repressing, impregnation, infiltration, machining, joining, etc. are performed on the P/M part.

It is common practice to use a lubricant for the compaction of ferrous powders. It is required mainly to reduce the friction between metal powders and die walls. By ensuring a good transfer of the compacting force during the compaction stage, it improves the uniformity of densification throughout the part. Besides, it also lowers the force required to remove the compact from the die, thus minimizing die wear and yielding parts with good surface finish.

The lubricant can be admixed with the ferrous powders or sprayed onto the die walls before the compaction. Die-wall lubrication is known to give rise to compacts with high green strength. Indeed, die-wall lubrication enables mechanical anchoring and metallurgical bonding between particles during compaction. However, die-wall lubrication increases the compaction cycle time, leads to less uniform densification and is not applicable to complex shapes. Therefore, in practice, the lubricant is most often admixed to the ferrous powders. The amount of lubricant is adjusted according to a specific application. Its content should be sufficient to minimize the friction forces at the die walls during the compaction and ejection of the parts. The amount of lubricant should, however, be kept as low as possible in the case of applications requiring high density level.

On the other hand, admixed lubricant most often reduces the strength of the green compact by forming a lubricant film between the metal particles which limits microwelding. When complex parts or parts with thin walls are to be produced, as well as when green parts have to be machined, parts with a high green strength are required. There is thus a need for a lubricant that would enable the manufacture of high green strength parts.

Most of parts produced by the P/M industry are compacted at room temperature without heating the powder and/or the tooling. This process is named "cold compaction". Parts which are "cold compacted" can reach a temperature of 50 to 70° C. at ejection due to friction at die walls. On the other hand, powder and tooling can also be moderately heated to temperatures up to 180° C. when parts with high density and/or high green strength are required. This process is known as warm compaction. Warm compaction takes advantage of the fact that a moderate increase of the compaction temperature lowers the yield strength of iron and steel particles and increases therefore their malleability, leading to an increase of density for a given applied pressure.

However, the temperature used in warm compaction may alter the properties of the admixed lubricant and therefore affect their lubrication behavior and flowability during the compaction and ejection stages. Effectively, most of lubricants that are suitable for cold compaction cannot be used in warm compaction due to their very poor lubricating and flowability properties. The poor lubricating properties result in high ejection forces. give parts with bad surface finish of ejected parts and increase die wear.

Conventional lubricants used in cold compaction include metallic stearates as zinc stearate or lithium stearate, or synthetic amide waxes as N,N'-ethylenebis(stearamide) or mixtures of metallic stearates and/or synthetic amide waxes. Polyethylene (PE) waxes, like CERACER 640, commercially available from Shamrock Technologies, have also been suggested as lubricants for cold compaction. Like synthetic amide waxes, polyethylene waxes have the advantage to decompose cleanly so that compacted parts are left free from residuals after the sintering operation. Shamrock Technologies report the use of their polyethylene wax lubricants to improve the green strength of metallic or ceramic bodies. However, Klemm et al., Adv. Powder Metall. & Particulate Mater., Vol. 2, 51–61 (1993), report in a study evaluating various P/M lubricants that the polyethylene wax tested lead to such a bad lubrication during the ejection of parts (high level of stick-slip), that they had to reject the idea to use this type of lubricant. In fact, the lubrication performance of PE waxes may vary drastically depending on the type of polyethylene waxes used. Indeed, Thomas et al. disclose in U.S. Pat. No. 6,140,278 that high density PE lubricants, having a weight-average molecular weight between 2,000 and 50,000, offer good lubrication of die walls and allow to obtain lower ejection forces than conventional lubricants, including low-density PE such as those supplied by Shamrock Technologies. Besides, unlike conventional lubricants and low-density PE lubricants, high density PE lubricants maintain their very good lubrication properties when moderately heated and give low ejection forces and good surface finishes. They also allow to obtain relatively high green strength up to 7000 psi and green densities up to 98% of the pore free density, which is known as a practical limit for warm pressing applications. High-density PE lubricants disclosed in the Thomas et al. patent, supra, can therefore be used for warm pressing.

Vidarsson discloses in PCT Application WO 99/11406 the use of linear chain polyethylene waxes having molecular weights between 500 and 10,000 and a polydispersity Mw/Mn preferably lower than 2.5, and more preferably lower than 1.5 for cold and warm compaction. No detailed description of the polymers covered by this application except for the molecular weight, the polydispersity and the melting point is given. In particular, no reference is made in this patent to the polarity or the oxidation state of the PE chains. No reference to any commercial PE waxes is also given in this application.

The presence or absence of polar-oxidized functional groups is known in the polymer industries as a key characteristic of PE waxes. Indeed, as described in U.S. Pat. No. 3,155,644, (col. 1, lines 42–63), non-polar PE waxes, "due to their inert nature, display poor receptivity for other materials" while oxidized PE waxes display improved adherence between polyethylene structures and substrate materials and improve bond strength between polyethylene surfaces and other base materials including metals.

Several US patents were issued in years 1964–1969 for processes of production of oxidized high-density polyethylene waxes.

Accordingly, and as it will be further described below, polyethylene waxes vary with regard to their lubrication performance and with regard to their possible use as lubricant for cold and warm compaction applications. It will be shown that polar-oxidized high-density PE waxes offer significantly better lubrication and compaction properties compared to non-polar high-density PE waxes.

SUMMARY OF THE INVENTION

It is an object of this invention to provide a lubricant for shaping ferrous powder compositions by powder metallurgy processes, effective either for cold or warm compaction, that can be admixed to the ferrous powder compositions or/and sprayed on the die walls of the tooling.

It is another object of this invention to provide ferrous powder compositions for the fabrication of ferrous-based powder compacts comprising a solid lubricant effective either for cold or warm compaction.

It is another object of the invention to provide lubricated ferrous powder compositions which when formed by P/M warm compaction techniques give parts with a high density and a high green strength and which can be ejected from the die cavity with relatively low ejection forces.

In accordance with the invention, there is provided a metal powder composition comprising a metal powder and from about 0.1 to about 3 wt. % of an oxidized high density polyethylene lubricant based on the total weight of the composition, preferably from about 0.2 wt. % to about 1.5 wt. %. This specific lubricant may be admixed to the metal powder in a solid state (commuted, usually as a powder), in emulsion, in solution or in the melted state. The oxidized high density polyethylene lubricant may be the only lubricant or it may be mixed with other conventional lubricants either separately or as a single-phase, to improve lubrication or the flowability of the powder compositions. Additionally, binders may be used to improve the flowability and/or to reduce segregation and dusting of the powder compositions.

Typically, the metal powder is an iron-based powder. Examples of iron-based powder are pure iron powders, powders of iron pre-alloyed with other elements, and powders of iron to which such other elements have been diffusion-bonded. The composition may further contain powders of such alloying elements in the amount of up to 15 wt. % of said composition. Examples of alloying elements include, but are not limited to, elemental copper, nickel, molybdenum, manganese, phosphorus, metallurgical carbon (graphite) and ferro-alloys.

Typically, the lubricant of the invention is an oxidized high-density polyethylene, which has a weight-average molecular weight Mw between about 1,000 and about 50,000, preferably between 2,000 and 20,000. The oxidized high-density polyethylene lubricant of the invention has typically a density of 0.95–1.05 g/cc and an acid number from 1 to 100 mg KOH/g.

The metal powder compositions of the invention can be compacted into parts in a die and subsequently sintered according to standard powder metallurgy techniques.

After compaction of the metal powder compositions of the invention, the metal parts produced may be heat treated, before the sintering step, at a temperature above the melting point of the lubricant to increase the mechanical strength of the green parts.

BRIEF DESCRIPTION OF THE DRAWINGS

The invention will be explained in more detail by way of the following disclosure to be taken in conjunction with the drawings, in which:

(FIG. 9*b* is a magnified fragment of FIG. 9*a*);

DETAILED DESCRIPTION OF THE INVENTION

Figure 1A:
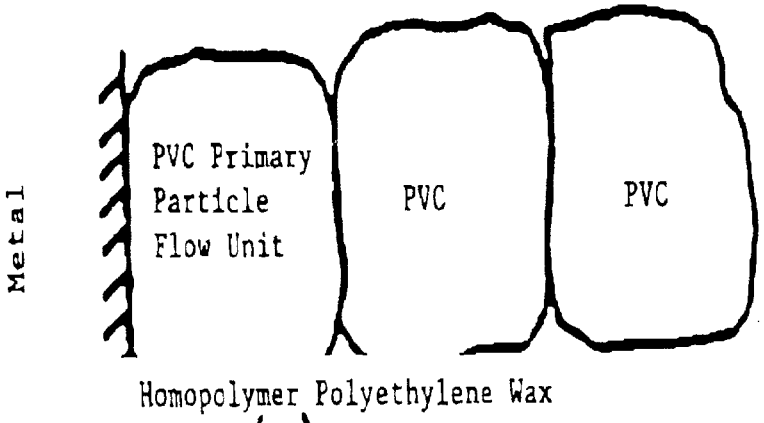
FIGS. 1*a*, 1*b* and 1*c* illustrate a model of polyvinylchloride lubrication (not to scale) showing metal lubrication and lubrication between polyvinyl chloride primary particle flow units for 1*a*) no lubricant, 1*b*) homopolymer polyethylene wax as lubricant, 1*c*) oxidized polyethylene wax as lubricant. Hydrocarbon chains are represented by lines and polar groups by circles. [from R. A. Linder, "Low-molecular weight polyethylene", in *Plastics Additives and Modifiers Handbook*, edited by J. Edentaum, Chapman & Hall, 1996, pp. 803–827.]

In accordance with the present invention, powder compositions containing an oxidized high-density polyethylene lubricant, suitable for the fabrication of ferrous compacts for P/M applications were prepared and tested. Exemplary metal powders suitable for the purpose of the present invention are any of iron-based powders used in the P/M industry, such as pure iron powders, pre-alloyed iron powders (including steel powders) and diffusion-bonded iron-based powders. Essentially any ferrous powder having a maximum particle size less than about 600 microns can be used in the composition of the invention. Typical ferrous powders are iron and steel powders including stainless steel and alloyed steel powders. ATOMET ® steel powders manufactured by Quebec Metal Powders Limited of Tracy, Quebec, Canada are representative of such iron and steel powders. These ATOMET ® powders contain in excess of 97 wt. % iron, less than 0.3 wt. % oxygen and less than 0.1 wt. % carbon, and have an apparent density of 2.50 g/cm$^3$ or higher and a flow late of less than 30 seconds per 50 g. Virtually any grade of iron and steel powders can be used.

Optionally, the iron-based powders can be admixed with alloying powders in the amount of less than 15 weight percent. Examples of alloying powders include, but are not limited to, elemental copper, nickel, molybdenum, manganese, phosphorus, metallurgical carbon (graphite) and ferro-alloys.

The powder composition of the invention includes a commuted oxidized high density polyethylene lubricant in an amount from about 0.1 to about 3 wt. % based on the total weight of the composition, preferably from about 0.2 wt. % to about 1.5 wt. %. This lubricant may be admixed in the solid state or in emusion. It can also be admixed in solution or in the melted state when agglomeration of powders or binding effect of the additives to ferrous powders are desired. The admixture may be carried out in a single operation or step, or in several steps. The average particle size of the lubricant is in the range of 1–150 $\mu$m, but preferably below 75 $\mu$m and more preferably below 45 $\mu$m. The oxidized high density polyethylene lubricant may be the only lubricant or it may be mixed with other conventional lubricants either separately or as a single-phase, as for example metallic stearates, synthetic amide waxes or low molecular weight polymeric lubricants, to improve lubrication or the flowability of the powder compositions. Additionally, binders as for example polyvinylpyrrolidone, may be used to improve the flowability and/or to reduce segregation and dusting of the powder compositions.

For the purposes of the invention, the oxidized high-density polyethylene lubricant of the invention has typically a density of 0.95–1.05 g/cc, preferably between 0.97 and 1 g/cc and an acid number from 1 to 100 mg KOH/g. The lubricant has a weight-average molecular weight $M_w$ between about 1,000 and about 50,000, preferably between 2,000 and 20,000.

Typically, oxidized high-density polyethylene waxes are different from other polyethylene waxes in that they are polar waxes, which consist mainly in linear macromolecular chains having polar groups along the chains. Examples of the polar groups include carboxyl groups, esters, as well as aldehydes, ketones, hydroxides, ethers and peroxides in various quantities. (R. A. Linder, "Low-molecular weight polyethylene", in *Plastics Additives and Modifiers Handbook*, edited by J. Edenbaum, Chapman & Hall, 1996, pp. 803–827.)

Indeed, to quote D. Munteanu, "Metal-containing polyethylenes waxes", *J. Macromol. Sci.-Chem.*, 1990, V. A27 (9–11), p.1395–1404, <<PE waxes are low molecular weight ethylene-based polymers that can have the following different chemical structures:

A. Homopolymers, i.e. unpolar waxes;

B. Oxidized Polyethylene Waxes, i.e. polar waxes with carboxyl aind ester groups;

C. Random Copolymers, i.e. polar waxes obtained by random copolymerisation of ethylene with polar comonorners such as vinyl acetate and acrylic acid, respectively EVA waxes and EAA waxes;

D. Graft Copolymers, i.e. polar waxes obtained by grafting homopolymers waxes with acid monomers such as maleic anhydride or acrylic acid;

E. Ionomeric Waxes, i.e. waxes with carboxylate bonds obtained by neutralizing the carboxylic groups of the low molecular weight EAA random copolymers (Na+, Ca++, Mg++, Zn++).>>

<<There are two basic routes to obtain low molecular weight chains for the PE waxes:

Ethylene polymerization under special conditions to assure only the formation of the low molecular weight polymers:

a at high pressure with radical initiators to produce low density homopolymer PE waxes (A) and random copolymers (C)

b at low pressure with Ziegler-Natta type catalysts to produce homopolymers PE waxes (A) of high density (0.94–0.98 g/cc) but also of low density (0.91–0.93 g/cc) when ethylene is polymerized in the presence of $\alpha$-olefins.

Degradation of usual molecular weight polyethylenes:

a thermally degradation to produce homopolymer waxes (A)

b thermo-oxidative degradation to produce oxidized waxes (B)>>

Concerning the object of the invention, oxidized high-density polyethylene waxes can thus be produced by two processes:

by melt oxidation of the low molecular weight high-density polyethylene waxes, or by solid state thermo-oxidative degradation of high molecular weight high-density polyethylenes.

As disclosed in U.S. Pat. Nos. 3,322,711, 3,329,667 and 3,410,816, oxidized high density polyethylene having molecular weight higher than 6,000 can be obtained by solid state oxidation of high density polyethylene having in general a weight average molecular weight in the range 20,000 to 2,000,000. The term "high density polyethylene" means ethylene homopolymers and copolymers of ethylene and other $\alpha$-olefins wherein said homopolymer and said ethylene copolymers have a density in the range 0.935 to 0.97 g/cc and a crystalline melting point in the range 115 to 137° C. prior to oxydation. This includes thus copolymers of ethylene and other $\alpha$-olefins such as propylene, butene-1, pentene-1, heptene-1 and the like, which copolymers have densities in the range 0.935 to 0.97g/cc and crystalline melting points in the range 115 to 137° C. prior to oxydation. Consequently, the density ranges of the oxidized products range between 0.937 and 1.05 g/cc, the exact value depending on the initial density of the starting polymer, and the extent of oxidation.

The following are (in quotation marks) excerpts from Linder (R. P. Linder, "Low-molecular weight polyethylene", in *Plastics Additives and Modifiers Handbook*, edited by J.

Figure 1B:
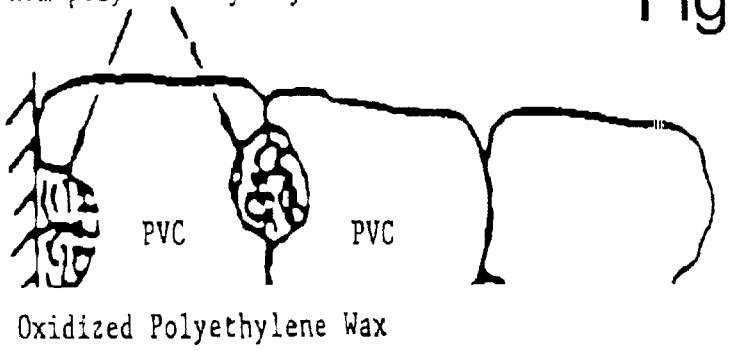
Figure 1C:
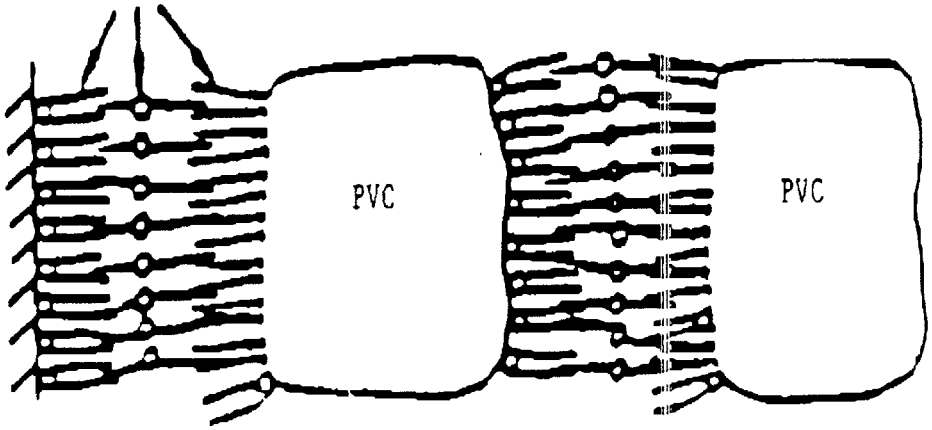

Edenbaum, Cnapman & Hall, 1996, pp. 803–827), interspersed with comments from the present inventors: <<oxidized polyethylenes were first developed with the intent of increasing the emulsifiability of the polymer wax for wax emulsions, not for polymer use. Then, it was found that these materials would act as metal-release agents for many plastics and elastomers>>. Nowadays, <<oxidized polyethylene waxes are used, especially as additives for plastics, aqueous emulsions and additives for organic coatings. Oxidized polyethylene waxes have been used as PVC lubricants with more or less pronounced internal lubricating effect, i.e. the higher the ratio between polar and unpolar groups in the wax structure, the more pronounced the internal lubricating effect of the oxidized PE waxes>>. Indeed, <<in plasticized-PVC systems, horrmopolymer polyethylene waxes are not used alone to give release of the PVC plasticized compound from the metal roll forming or processing equipment>>, because <<the polyethylene wax has no affinity with either the metal surface and the polymer>>. In fact, homopolymer polyethylene waxes are used in conjunction with fatty acids and metal soaps. <<It is theorized that the fatty acids or he metal soaps coats the polymer and metal surfaces, forming a hybrid lubricant system which forms a multilayer film with the metal soaps yielding an efficient metal-release system. This hybrid system gives a much more efficient metal release than either the polyethylene or the metal soaps>>. On the other hand, <<oxidized polyethylenes are effective as internally compounded metal-release agents in polymers (PVC, ABS). Oxidized polyethylenes have advantage's over other typical lubricants. Stearic acid volatilizes at elevated temperatures. EBS wax dissassociates and looses its lubricating functionality at high temperatures. High-density oxidized polyethylenes have a good affinity for metal surfaces and coats them, giving very efficient effect>>. FIGS. 1*a–c* show a model of polyvinylchloride lubrication (not to scale) showing metal lubrication and lubrication between polyvinyl chloride primary particle flow units for 1*a*) no lubricant, 1*b*) homopolymer polyethylene wax as lubricant, and 1*c*) oxidized polyethylene wax as lubricant. The advantage of the oxidized PE wax is clearly visible.

It is believed that, in the P/M processes, the good lubrication observed during either the compaction and the ejection of the powder compositions of the invention is due in particular to the high linearity of the macromolecular chains which are able to slide one on the other, as well as to the polar groups along the polymer chains which confer a good affinity for metal die and metal powders surfaces and coat them, giving very efficient lubricating effect. Commercially available oxidized high-density polyethylenes, suitable as P/M lubricant in accordance with the present invention, are for example the Ceridust 3715 or Ceridust 3719 from Clariant Inc., or the ACumistA-12 from Honeywell. These oxidized high-density polyethylenes have been used thus far as additives for plastics, aqueous emulsions and additives for organic coatings, but have not yet been proposed as lubricants for press-and-sinter P/M applications.

The metal powder compositions of the invention can be compacted using conventional powder metallurgy conditions. The compacting pressures are typically lower than 85 tsi and more specifically between 10 and 60 tsi. For warm compaction, the die temperature suitable with the compositions of the invention is below about 200° C., preferably below 150° C., and more preferably between 90 and 130° C.

The lubricants of the invention, which contain an oxidized high density polyethylene may be used in the ferrous powder compositions or/and sprayed into die cavities or punches. To spray the lubricant on the die walls of the compacting tooling, apparatus such as the electrostatic die wall lubrication unit described in U.S. Pat. application Ser. No. 09/442,411, may be used.

After cornpactior, of the metal powder compositions of the invention, the metal parts produced may be heat treated, before the sintering step, at a temperature above the melting point of the lubricant to increase the mechanical strength of the green parts, so as to facilitate the handling and enable secondary operations such as green machining before sintering.

As it will be shown later in the examples below, and as described by Tremblay et al. [L. Tremblay, Y. Thomas, "*Enhanced Green Strength Lubricatinc Systems for Green Machining Ferrous Materials*", Advances in Powder Metallurgy & Particulate Materials, MPIF, 1999, Vol. 1, 2.141–2.1561], this enhancement of green strength of compacted parts by using a thermal treatment is not observed with conventional lubricants such as synthetic amide waxes. One explanation may be that the lubricant of the invention above its melting point flow into the porosity during the thermal treatment and forms a network of lubricant sufficiently strong to enhance the green strength.

EXAMPLES

DESCRIPTION OF MATERIALS AND EXPERIMENTAL PROCEDURES USED

Several commercial high-density polyethylene waxes having different molecular weights were evaluated, namely Ceridust 3620, Ceridust 3715 and PE190 commercially available from Clariant Corporation, and AC307 and ACumist A12 commercially available from Honeywell International, Inc. The characteristics of these polyethylene waxes are given in Table 1. The weight and number average molecular weights ($M_w$ and $M_n$) were determined by size exclusion chromatography using narrow polyethylene standards for calibration. Melting temperatures (onset and melting point peak) were determined by differential scanning calorimetry (DSC). Ceridust 3715, AC307 and ACumist A12 are oxidized high-density polyethylenes having different molecular weights and levels of oxidation, with respectively an acid number of 4, 4–8 and 26–40 mg KOH/g. All these PE lubricants are within the scope of this invention. Ceridust 3715 is a micronized powder with an average mean diameter of ~9 $\mu$m. AC307 is supplied in granules or powders having an average mean diameter of ~100–125 $\mu$m, while ACumist A12 is supplied in a micronized powder form having an average mean diameter of ~12 $\mu$m. Cericlust 3620 and PE190 are non-oxidized or unpolar high-density polyethylenes. Ceridust 3620 is a micronized powder with an average mean diameter of ~9 $\mu$m, while PE190 is supplied in granules (<500 $\mu$m).

Figure 2:
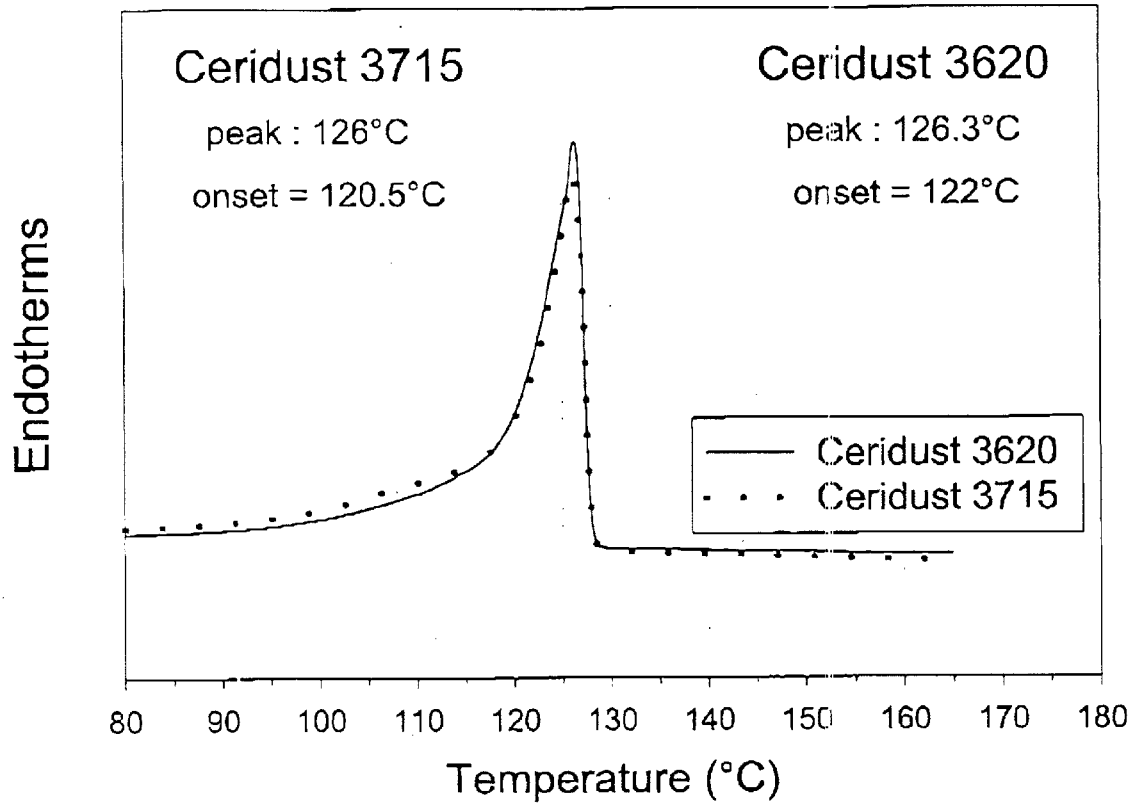
FIG. 2 shows Different al Scanning Calorimetry (DSC) thermograms (10 deg.C/min) of Ceridust 3620, a high density polyethylene wax, and of Ceridust :3715, an oxidized high density polyethylene.

Turning to Table 1 and FIG. 2, it can be seen that Ceridust 3620 and Ceridust 3715 are very similar in melting behavior as well as in density and molecular weights, and differ by the oxidation state, which helps in evaluating the influence of the oxidation on the behavior of these lubricants.

Since PE190 and AC307 are only commercially available in graniule form, they were both micronized with an air jet mill to obtain fine powders with size distribution similar to that of the other PE lubricants, i.e. an average mean diameter of about 10 $\mu$m.

TABLE 1

Properties of HDPE used in examples 1 to 4.

| HDPE type | Name | Acid Number mg KOH/g | Density, g/cm$^3$ | Melting temperature DSC(° C.) | Mw, g/mol[2] | Mn, g/mol[2] | Mw/Mn |
|---|---|---|---|---|---|---|---|
| Non-oxidized | Ceridust 3620* | — | 0.97 | −122 peak: ~126.3 | 5,350 | 1,350 | 4.0 |
| Non-oxidized | PE190* | — | 0.95–0.97 | ~125 peak: 133 | 19,200 | 7,300 | 3.0 |
| Oxidized | Ceridust 3715* | 4 | 0.97 | ~120.5 peak: ~126 | 5,060 | 1,240 | 4.1 |
| Oxidized | Acumist AC307* | 4–8 | 0.98 | −130 peak: ~135 | 19,400 | 9,300 | 2.1 |
| Oxidized | Acumist A12* | 26–40 | 0.99 | −130.7 peak: ~137 | 11,000 | 3.600 | 3.0 |

1 Melting temperatures were determined by differential scanning calorimetry.
2 Mw and Mn were determined by size exclusion chromatography calibrated with narrow polyethylene standards
*Outside the scope of the invention.

The ferrous powder compositions tested contained 98.9 wt% ATC(:MET 1001 steel powder produced and sold by Quebec Metal Powders Ltd., 0.6 wt% graphite powder (South Western 1651) and 0.5 wt% of PE lubricant. PE Lubricants were admixed to the iron and graphite particles either by a wet or dry admixing method. For the wet admixing method, PE lubricants were dissolved in a solution, then added to the ferrous and graphite mix and wet-mixed to ensure a homogeneous distribution of the solution. The solvent was then removed, leaving a thin coating of PE materials around all the iron and graphite particles. This procedure was used to eliminate the effect of average particle size on compaction and lubrication properties and enable direct comparison between the different lubricants. For the dry admixing method, PE waxes in a micronized powder form were dry-mixed with the ferrous and graphite powder in a blender under typical conditions used in the PM industry.

The compaction and ejection characteristics of the ferrous powder compositions either wet or dry-mixed were evaluated with a single action instrumented compacting device, known as the Powder Testing Center Model PTC 03DT, manufactured by KZK Powder Technologies Corporation, Cleveland, Ohio. This instrumented press allows continuous recording of the moving punch displacement, the forces applied to the moving punch and transmitted to the stationary punch and the IN-die density all along the compaction and ejection processes. The stripping pressure, which corresponds to the force needed to start the ejection process divided by the friction area (contact surface between the compact and the die wall) and the ejection unit energy were estimated from the ejection curve in order to compare the lubricating performance of lubricants. The ejection unit energy is evaluated from the calculation of the area under the ejection curve (force vs. displacement) divided by the displacement of 2.54 mm and the friction area.

EXAMPLE 1

Figure 3A:
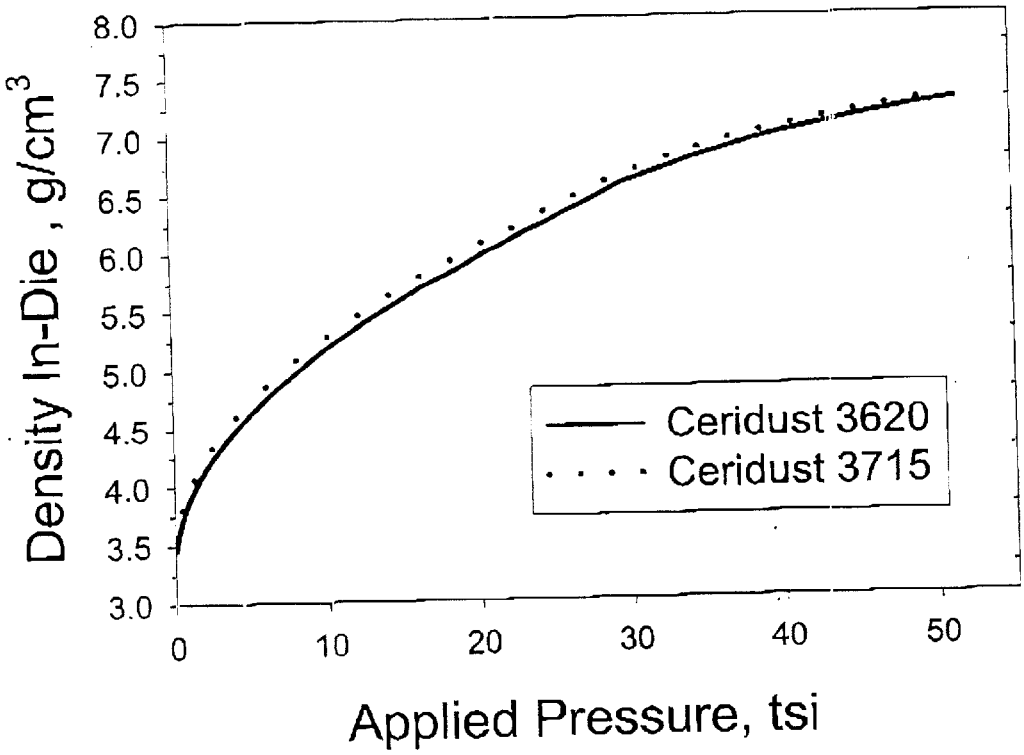
FIGS. 3*a* and 3*b* illustrate densification curves of powder compositions lubricated with Ceridust 3620 and Ceridust 3715, compacted at 45° C.
Figure 3B:
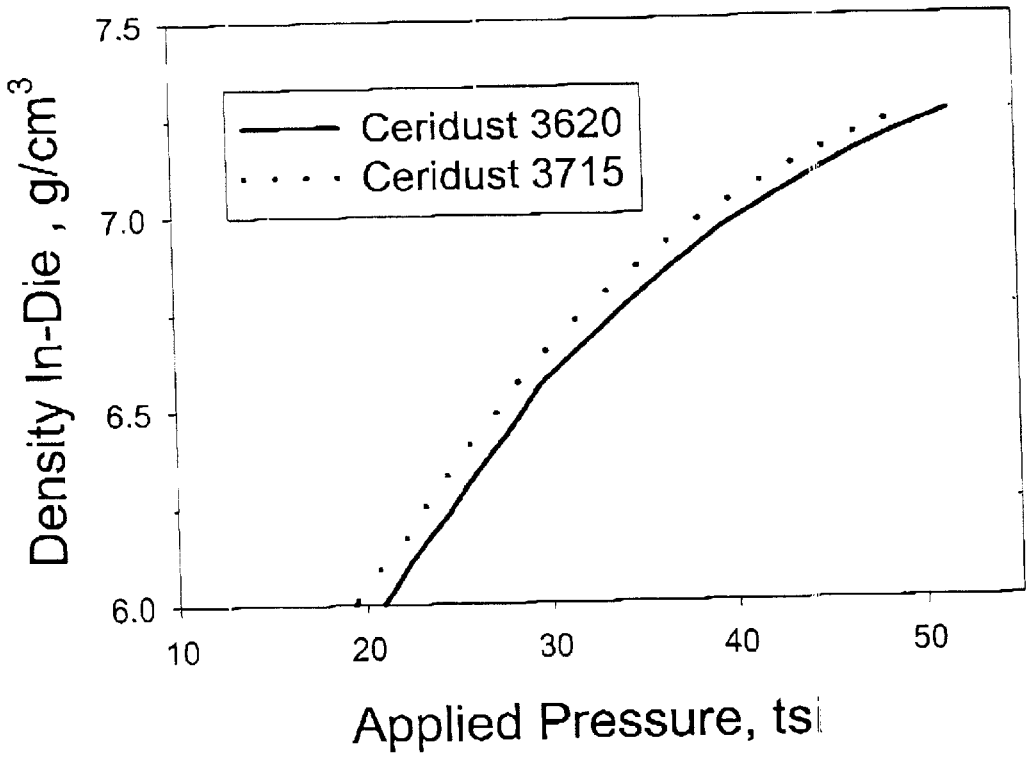
Figure 4B:
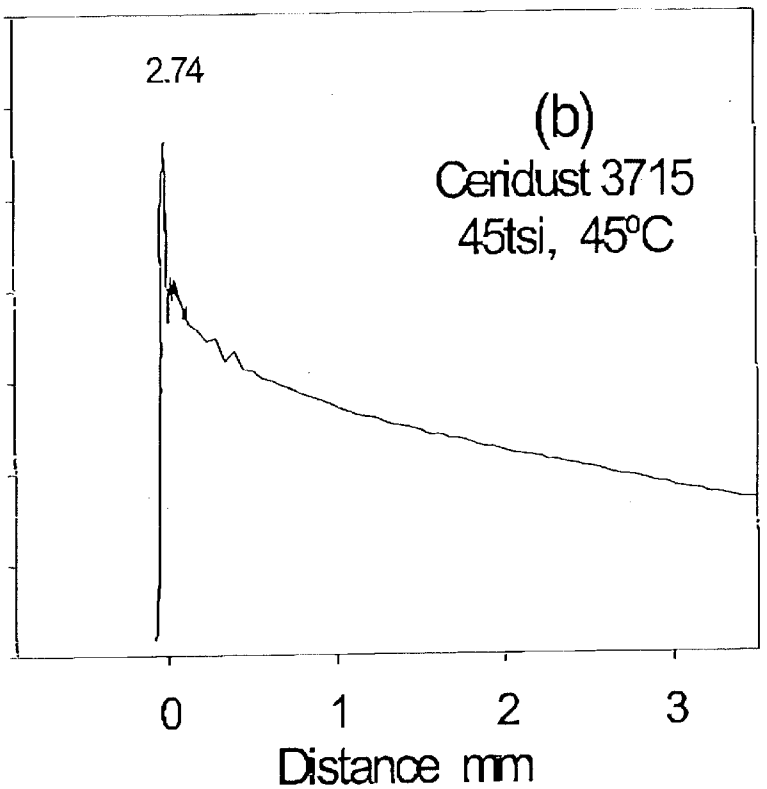
FIGS. 4*a* and 4*b* illustrate ejection curves of powder compositions lubricated with, respectively Ceridust 3620 and Ceridust 3715, compacted at 45 tsi and 45° C.
Figure 4A:
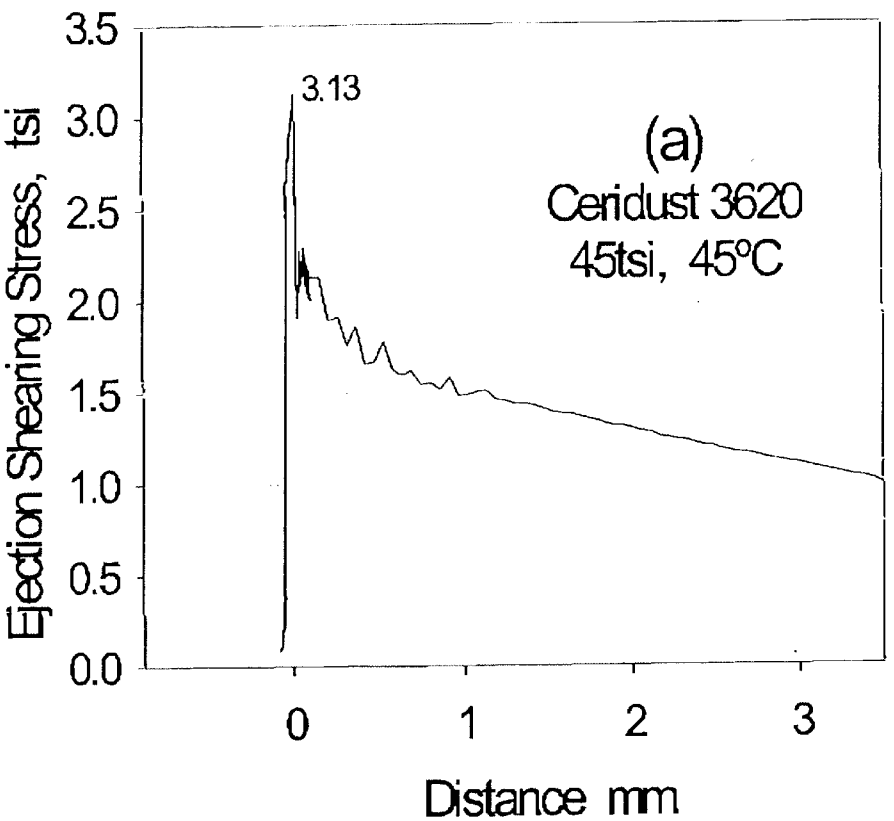

Ferrous powder compositions containing coated Ceridust lubricants having a $M_w$ of about 5,000 g/mol were compacted to a constant pressure of 45 tsi at 45° C. in the PTC. Results of compaction tests are summarized in Table 2, while the compressibility curves are shown in FIGS. 3*a* and 3*b*. It is seen that the compressibility of the composition containing the oxidized high-density PE (Ceridust 3715) was significantly better than that obtained with the non-oxidized PE (Ceridust 3620). IN-Die and green densities of Ceridust 3715 were about 0.05 g/cm$^3$ higher than that of CERIDUST 3620. The lubrication performance of Ceridust 3715 was also better than that obtained with Ceridust 3620. Indeed, the ejection energy and the stripping pressure were about 10% lower with Ceridust 3715. In addition, the level of the stick-slip phenomenon as indicated by the jump and drops in pressure observed during the ejection process was also more significant with Ceridust 3620 as shown in FIGS. 4*a* and 4*b*. This phenomenon is indicative of intermittent disruptions of the lubricant film at die walls. As a result of this, the surface finish of compacted specimens was significantly better with Ceridust 3715 than with Ceridust 3620.

TABLE 2

Compaction and ejection properties of ferrous compositions with coated HDPE compacted at 45 tsi and 45° C. in the PTC.

| Lubricants | Type | Mw G/mol | Acid Number | In-Die Density g/cm$^2$ | Green Density g/cm$^2$ | Stripping Pressure Tsi | Ejection Unit Energy MJ/m$^3$ |
|---|---|---|---|---|---|---|---|
| Ceridust 3620 | Non-oxidized | 5,350 | — | 7.115 | 6.986 | 3.09 | 20.43 |
| Ceridust 3715 | Oxidized | 5,060 | 4 | 7.157 | 7.034 | 2.78 | 18.28 |

EXAMPLE 2

Figure 5:
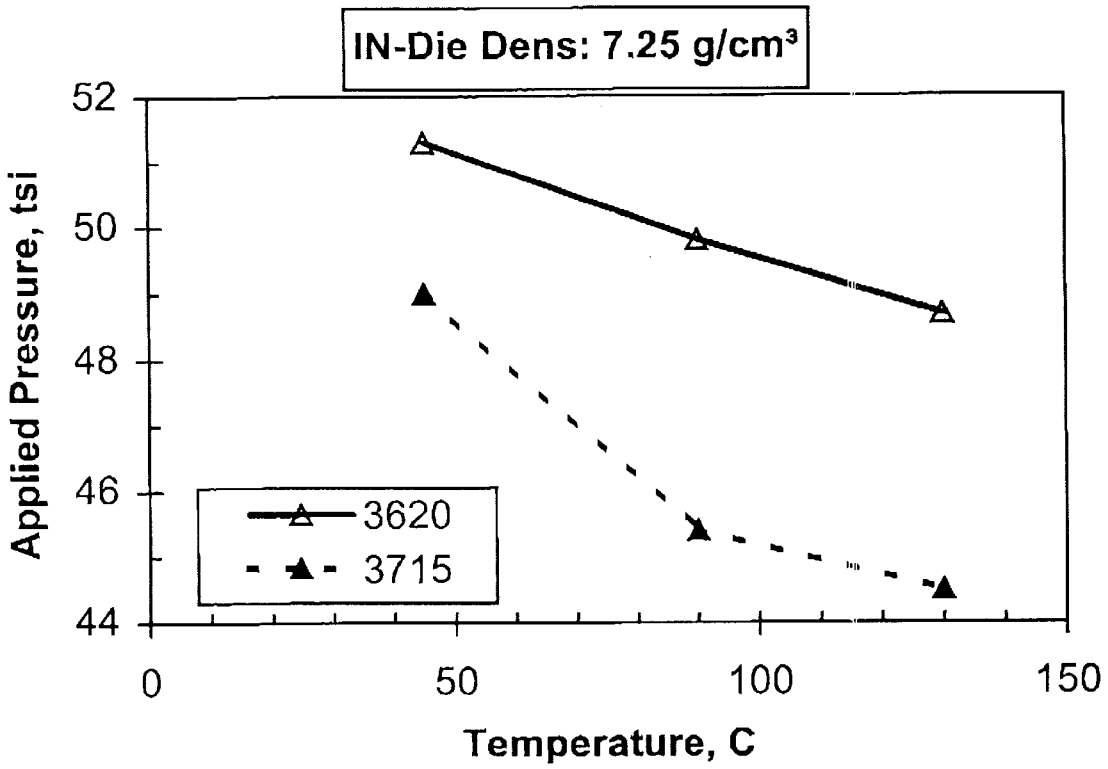
FIG. 5 illustrates the effect of varying the compacting temperature on the compressibility at an IN-Die density of 7.25 g/cm$^3$ for Ceridust 3620 and Ceridust 3715.

The same powder compositions as in Example 1 were compacted in the PTC to a constant IN-die density of 7.25 g/cm$^3$ at different compacting temperatures: 45, 90 and 130° C. Results of these compaction tests are given in Table 3 and shown in FIGS. 5 and 6. As expected, the compressibility of both mixes was improved as compacting temperature increased as shown in FIG. 5. However, the gain in compressibility obtained when increasing the compacting temperature from 45 to 130° C. was higher for the oxidized PE Ceridust 3715, namely 4.5 tsi versus 2.6 tsi for the non-oxidized PE Ceridust 3620. In addition, it is clearly seen that the compressibility of mixture with the oxidized PE wax (Ceridust 3715) was significantly better than that of mixture with the non-oxidized HDPE wax Ceridust 3620) at any compacting temperature. Indeed, the difference in applied pressure needed to reach 7.25 g/cm$^3$ IN-Die was respectively 2.3, 4.4 and 4.2 tsi at 45, 90 and 130° C. It is worth mentioning that the difference in compressibility between the polar and unpolar PE waxes is similar to the gain induced by the compacting temperature itself. In other words, the compressibility of Ceridust 3715 at 45° C. was similar to that of Ceridust 3620 at 130° C.

Figure 6B:
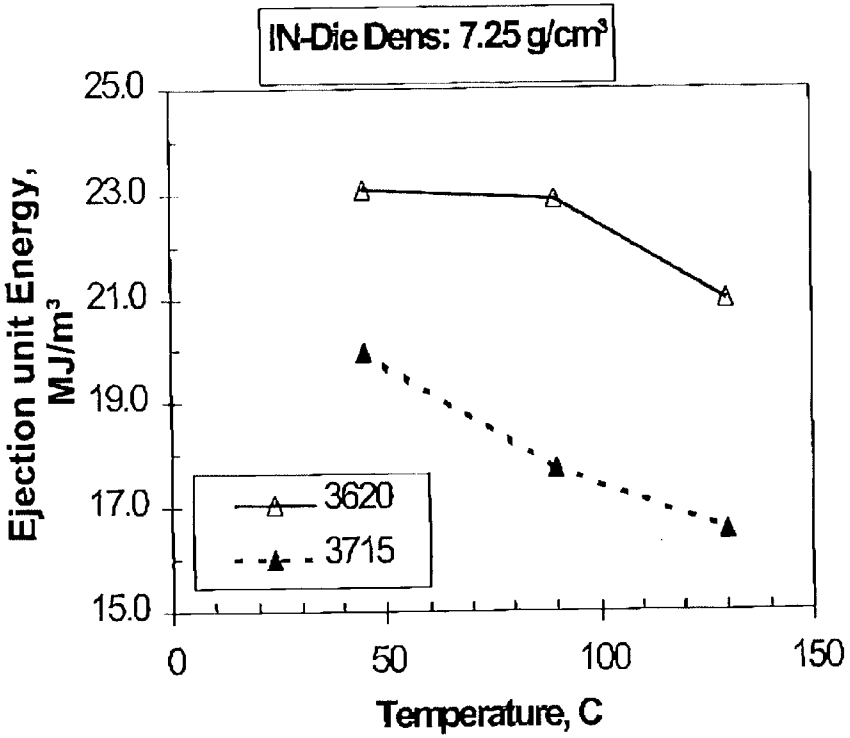
FIGS. 6*a* and 6*b* illustrate respectively the effect of varying the compacting temperature on the stripping pressure and the ejection energy of specimens pressed to an IN-Die density of 7.25 g/cm$^3$) for Ceridust 3620 and Ceridust 3715.
Figure 6A:
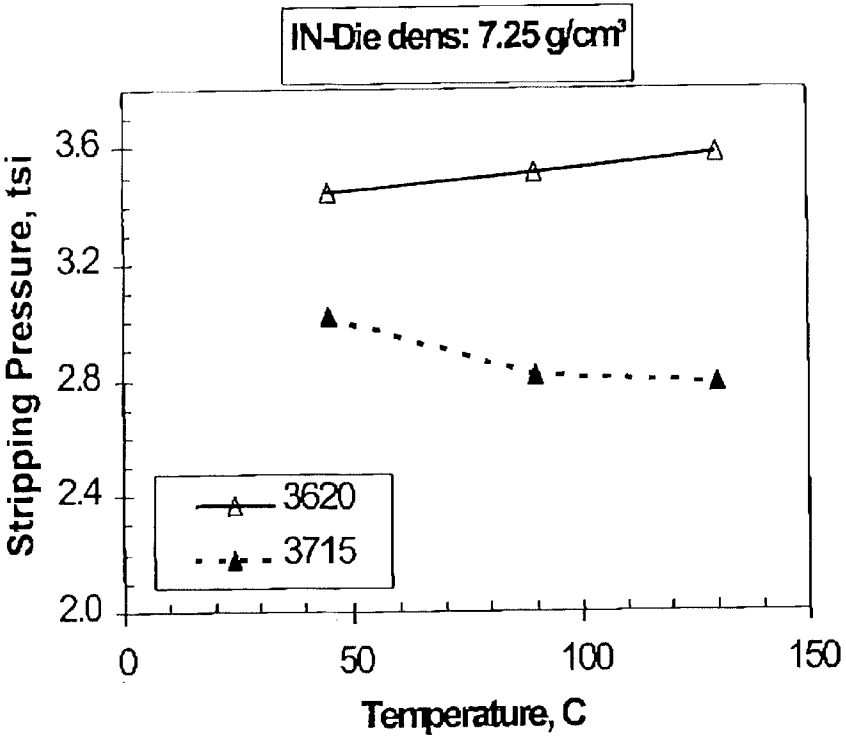

The variation of the stripping pressure and the ejection energy as a function of the compacting temperature is shown in FIGS. 6*a* and 6*b* respectively. As observed in the first example, the stripping pressure and the ejection unit energy remained significantly lower with Ceridust 3715 than with Ceridust 3620 at any temperatures. For example, the stripping pressure and the ejection energy at 90° C. was respectively 2.81 is i and 17.74 MJ/m$^3$ with Ceridust 3715 versus 351 tsi and 22.88 MJ/ml with Ceridust 3620. In fact, the differences in stripping pressure and ejection energy were about 12% at 45° C. and 20 to 22% at 90 and 130° C. it can be observed in FIGS. 6*a* and 6*b* that the lubrication properties of Ceridust 3715 were slightly better as temperature increased as shown by the reduction in stripping pressure and ejection energy.

TABLE 3

Compaction and ejection properties of ferrous compositions with coated HDPE pressed to an IN-Die density of 7.25 g/cm$^3$ at different temperatures in the PTC.

| Lubricant | Type | Comp. Temp ° C. | Green Density g/cm$^3$ | Applied Pressure Tsi | Net Pressure Tsi | Stripping Pressure Tsi | Ejection Unit Energy |
|---|---|---|---|---|---|---|---|
| Ceridust 3620 | Non-Oxidized | 45 | 7.088 | 51.3 | 42.1 | 3.45 | 23.08 |
| | | 90 | 7.109 | 49.8 | 40.5 | 3.51 | 22.88 |
| | | 130 | 7.116 | 48.7 | 39.1 | 3.58 | 21.00 |
| Ceridust 3715 | Oxidized | 45 | 7.101 | 49.0 | 40.3 | 3.02 | 19.98 |
| | | 90 | 7.109 | 45.4 | 37.2 | 2.81 | 17.74 |
| | | 130 | 7.108 | 44.5 | 36.3 | 2.79 | 16.53 |

EXAMPLE 3

Figure 7:
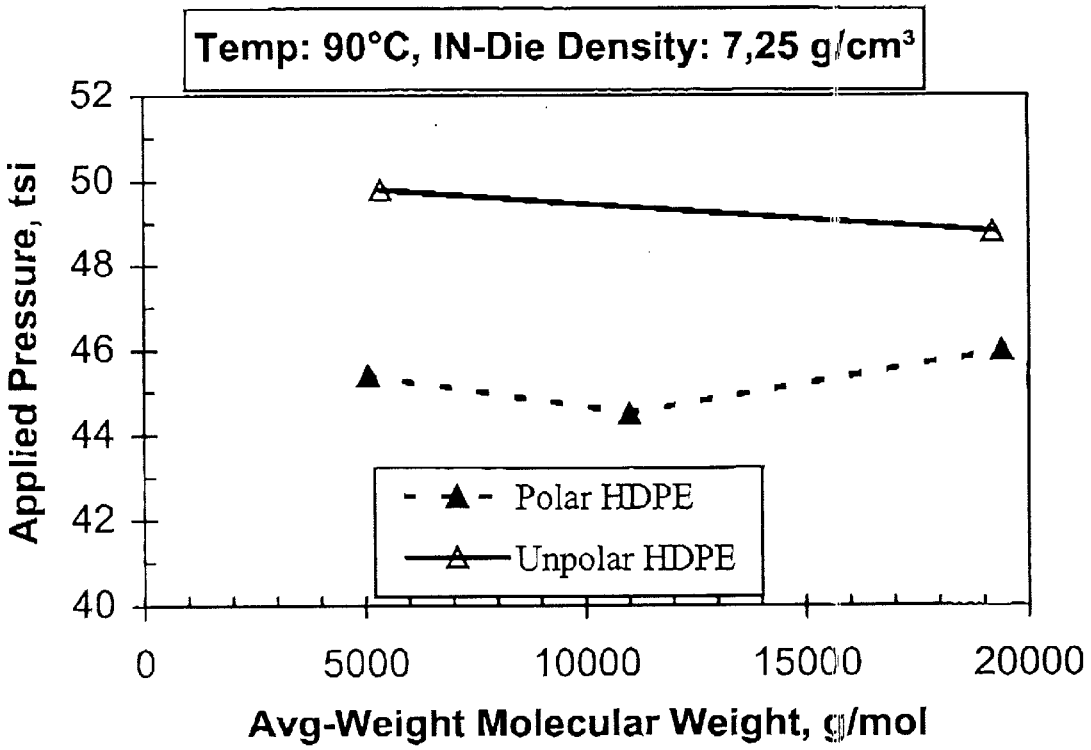
FIG. 7 illustrates the effect of weight-average molecular weight on compressibility for unpolar and polar HDPE waxes.
Figure 8B:
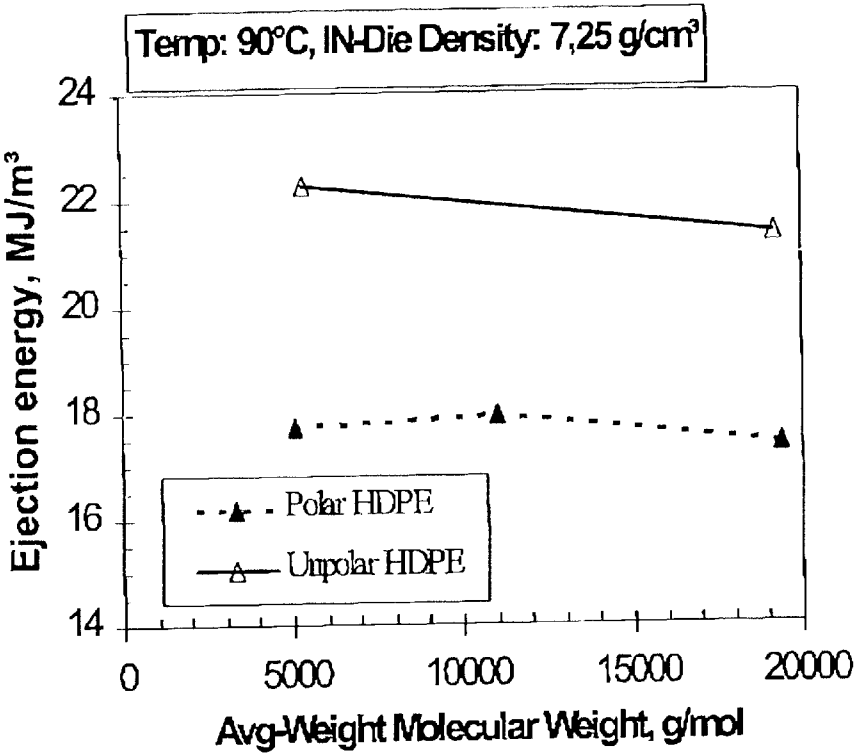
FIGS. 8*a* and 8*b* illustrate the effect of weight-average molecular weight on the stripping pressure (8*a*) and the ejection energy (8*b*) for polar and unpolar PE waxes.
Figure 8A:
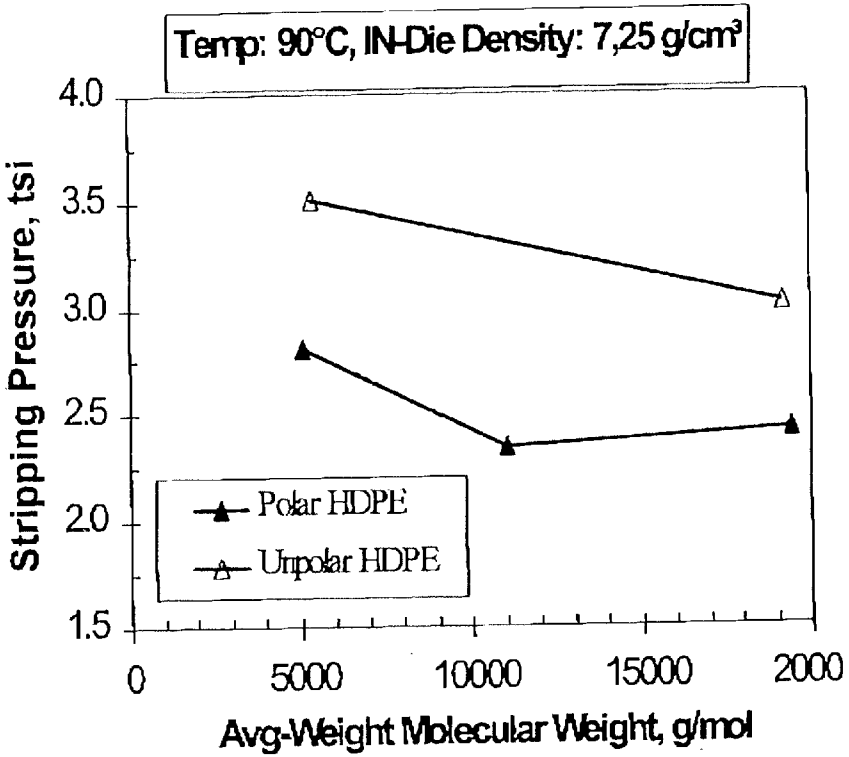
Figure 9A:
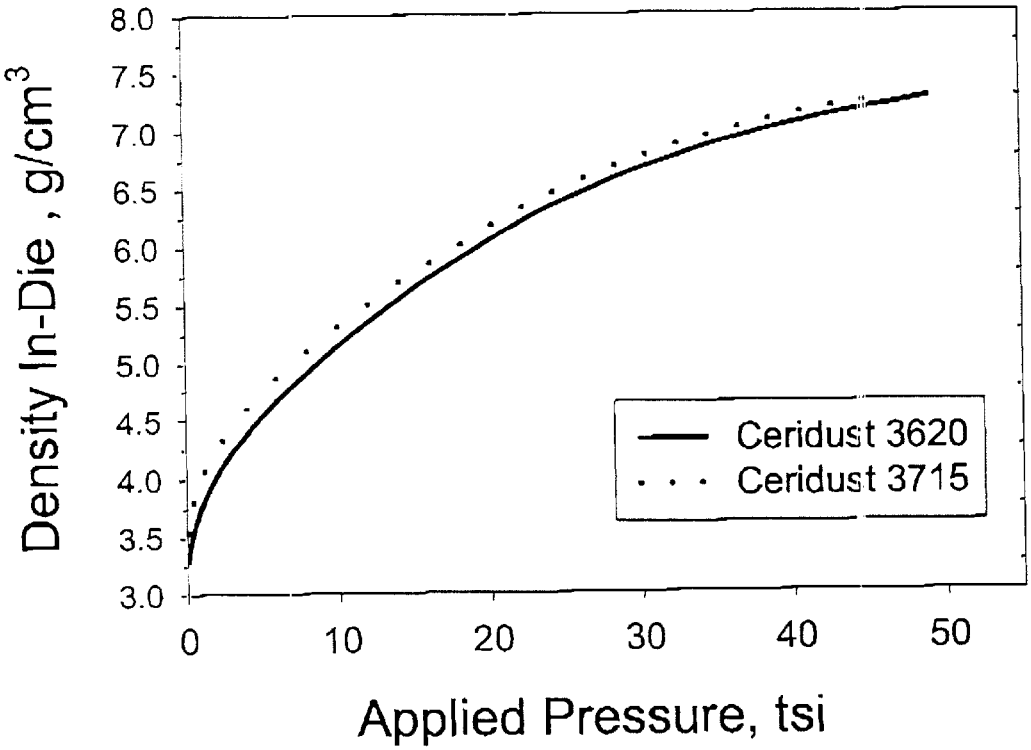
FIGS. 9*a* and 9*b* illustrate densification curves at 90° C. of compositions with HDPE (Ceridust 3620) and oxidized HDPE (Ceridust 3715) lubricants in powder form
Figure 9B:
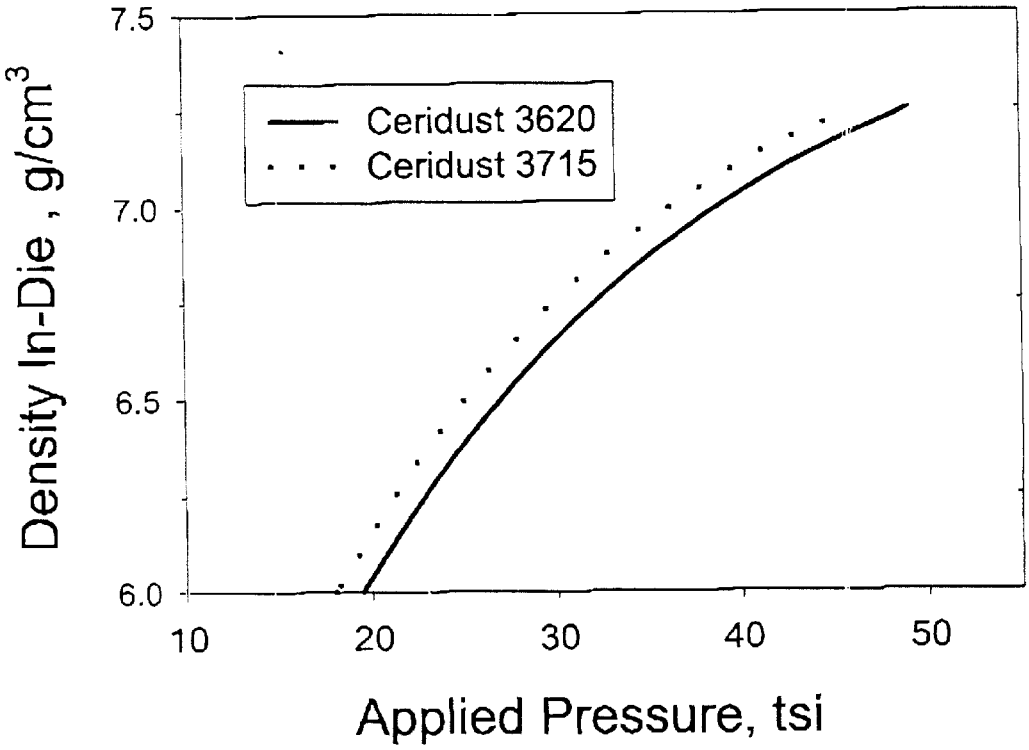
Figure 10A:
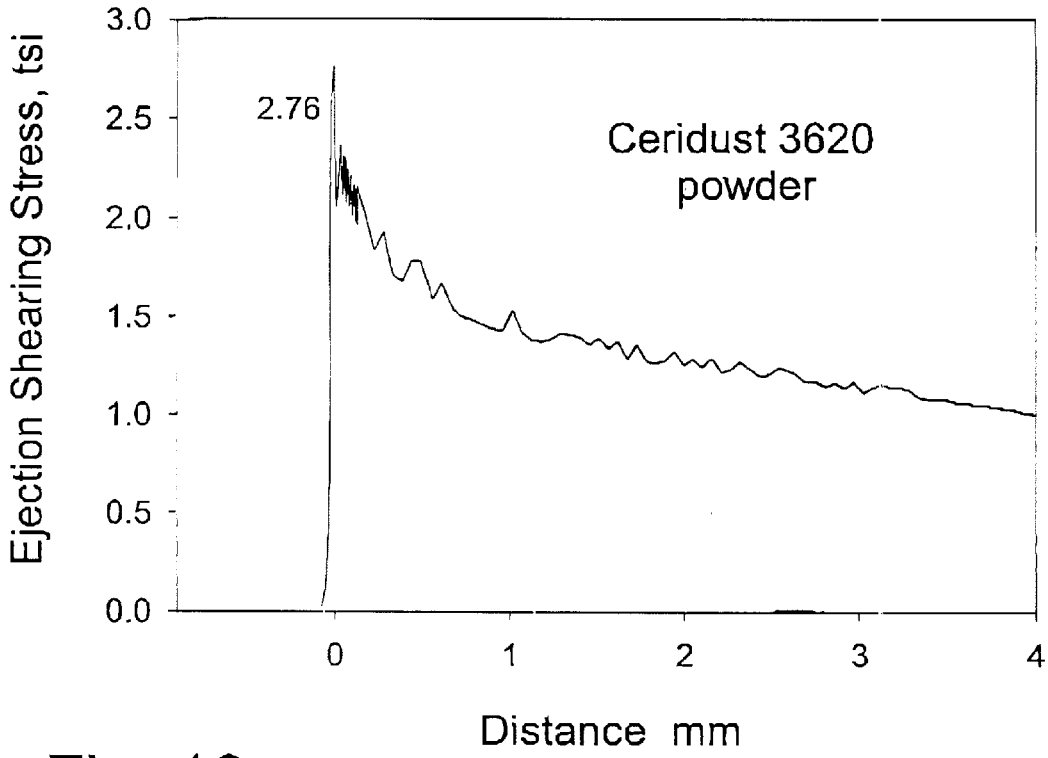
FIGS. 10*a* and 10*b* show ejection curves of parts compacted at 45 tsi and 90° C. from compositions containing HDPE (Ceridust 3620) (FIG. 10*a*) and oxidized HDPE (Ceridust 3715) (FIG. 10*b*) lubricants in powder form.
Figure 10B:
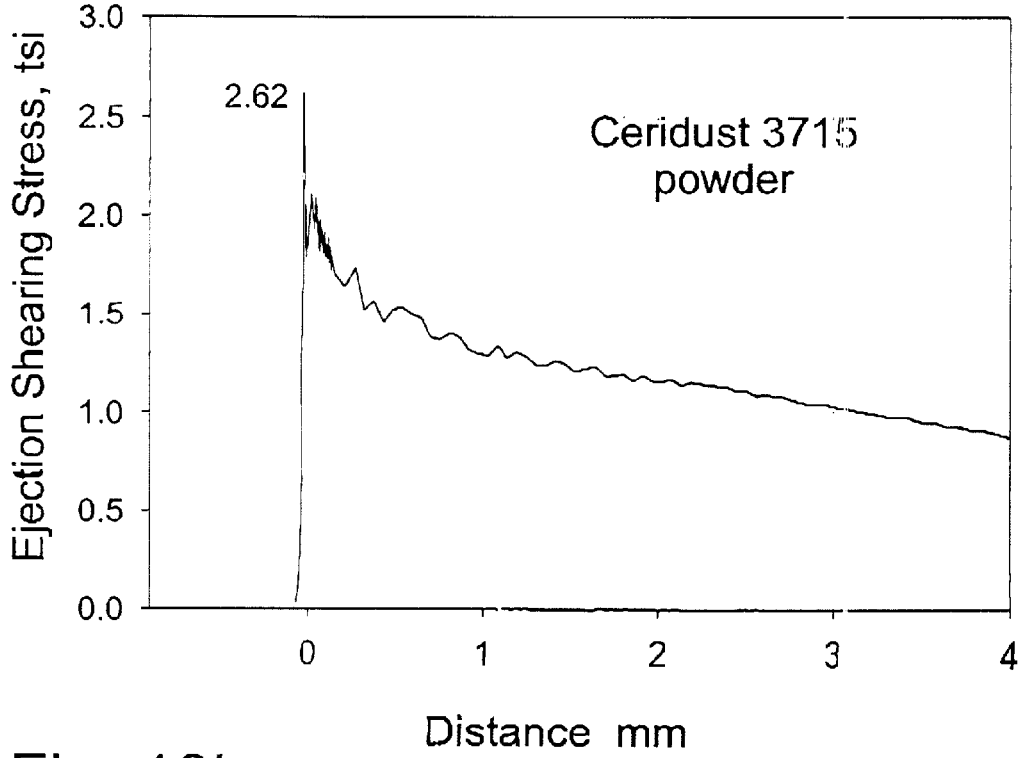
Figure 11A:
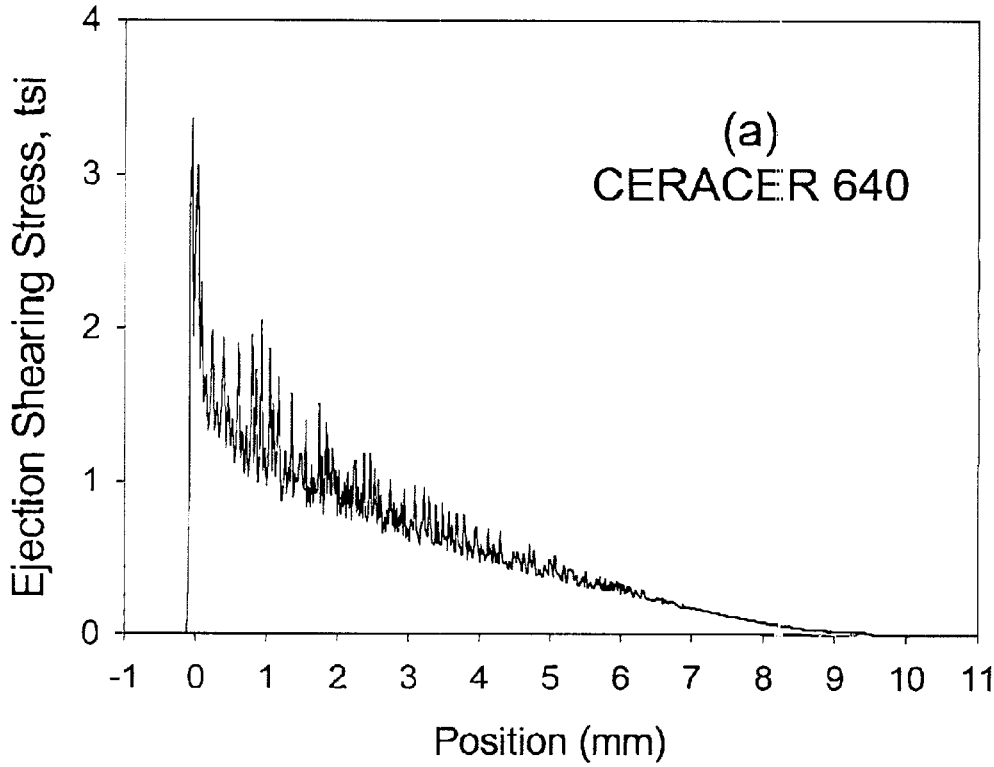
FIGS. 11*a* and 11*b* show ejection curves of parts compacted at 45 tsi and 65° C. from compositions containing ATOMET 1001/0.6 wt. % graphite and (11*a*) 0.75 wt. % low density polyethylene LDPE (CERACER 640) and (11*b*) 0.75 wt. % oxidized HDPE (ACumist A12).
Figure 11B:
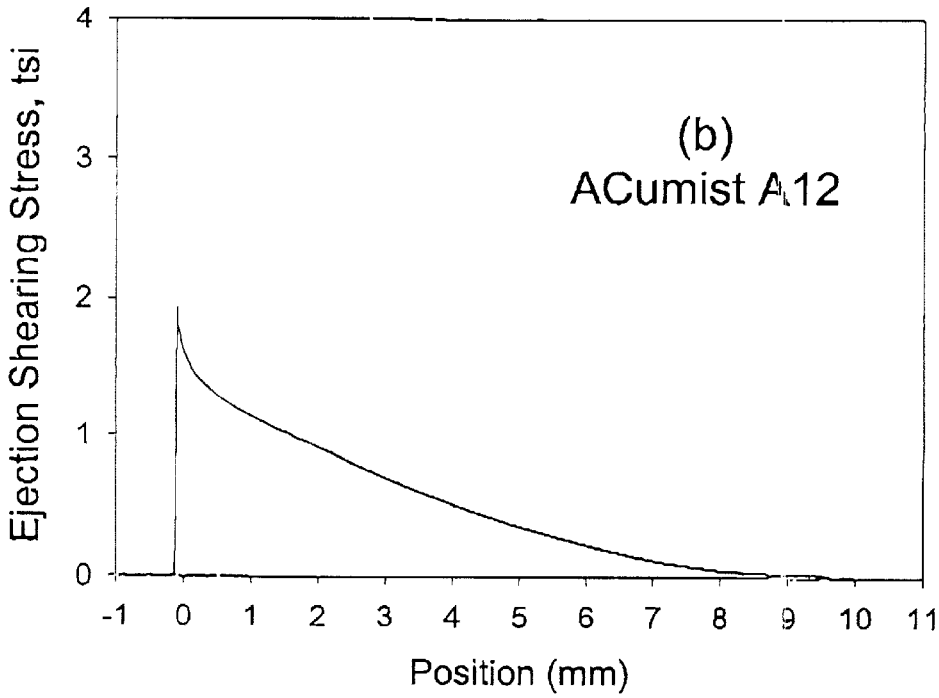

The compaction and ejection properties of ferrous powder compositions containing coated polar and non-polar HDPE waxes with different Molecular weights were evaluated in the PTC at an IN-die density of 7.25 g/cm$_3$ and a compacting temperature of 90° C. Results of these compaction tests are given in Table 4, while the effect of molecular weight on compressibility and ejection properties are shown in FIGS. 7 and 8. Lubricants tested can be subdivided in different groups according to their molecular-weight: Ceridust 3620 and Ceridust 3715 with a $M_w$ of about 5,000 gimol, PE190 and AC307 with a $M_w$ of about 19,000 g/mol and Acumist A12 with a $M_w$, of 11,000 g/mol.

The trend obtained with PE waxes having a $M_w$ of about 19,000 g/mol was identical to that obtained with PE waxes having a much lower $M_w$. Indeed, the compressibility as well as the lubrication performance of the oxidized PE waxes was significantly better than that of the non-oxidized PE waxes, regardless of the molecular weight. For example, the applied pressure, the stripping pressure and the ejection energy were respectively 46 tsi, 2.4 tsi and 17.4 MJ/m$_3$ with AC307 ($M_w$=19,400 g/mol) compared to 48.8 tsi, 3.0 tsi and 21.4 MJ/m$^3$ with PE190 ($M_w$=19,200 g/mol). The difference in stripping pressure and ejection energy between the polar and non-polar PE waxes was about 20% at both 5,000 and 19,000 g/mol. Finally, the stick and slip phenomenon was also more important with the non-polar PE wax (PE190) than with the partly oxidized one (AC307) as observed with the PE waxes group having lower molecular weight.

It can be seen in FIG. 7 that, when the wet admixing method was used, the molecular weight of the PE lubricant had only a slight effect on the compressibility of mixtures containing both polar and unpolar PE waxes. Indeed, the compacting pressure needed to reach 7.25 g/cm$^3$ varied by only 1 tsi for the unpolar PE waxes (Ceridust 3620 and PE190) while it varied by about 1.5 tsi for the polar PE waxes (Ceridust 3715 and Acumist A12 and AC307). In comparison, the difference in applied pressure between the polar and unpolar PE groups was between 2 and 4 times higher, namely 4.4 tsi at about 5,000 g/mol and 2.8 tsi at about 19,000 g/mol. Similar trends were observed for the ejection properties, FIG. 8. The stripping pressure decreased slightly when the molecular weight increased for both the oxidized and non-oxidized PE waxes. However, on the other hand, the ejection energy remained almost unchanged as the molecular weight varied. As it was the case with the compressibility, the variation induced by the molecular weight was much less significant than that induced by the type of functional group on PE chains.

Therefore, based on these results, the presence or not of polar functional groups on the polymeric chains has a much stronger effect than the molecular weight on the compressibility and lubrication performance of high-density PE waxes.

TABLE 4

Compaction and ejection properties of ferrous compositions with coated HDPE pressed to an IN-die density of 7.25 g/cm$^3$ and 90° C. in the PTC.

| Lubricant | Type | Mw g/mol | Green Density g/cm$^3$ | Applied Pressure tsi | Stripping Pressure tsi | Ejection Unit Energy MJ/m$^3$ |
|---|---|---|---|---|---|---|
| Ceridust 3620 | Non-oxidized | 5,350 | 7.109 | 49.8 | 3.51 | 22.88 |
| Ceridust 3715 | Oxidized | 5,060 | 1.109 | 45.4 | 2.81 | 17.74 |
| A12 | Oxidized | 11,000 | 7.116 | 44.5 | 2.35 | 17.97 |
| PE190 | Non-oxidized | 19,200 | 7.109 | 48.3 | 3.02 | 21.37 |
| AC307 | Oxidized | 19,400 | 7.119 | 46.0 | 2.42 | 17.40 |

EXAMPLE 4

PROPERTIES OF HDPE IN POWDER FORM

Results of compaction tests carried out at 45 tsi and 90° C. with mixtures containing different oxidized and non-oxidized powdered PE waxes are given in Table 5 and FIGS. 9*a*, 9*b* and 10*a*, 10*b*. The results indicated that the oxidized high density polyethylene (Ceridust 3715) lead again to significantly better compressibility and lubrication performance than high density polyethylene (Ceridust 3620). With non oxidized HDPE, such as Ceridust 3620, it was observed that higher applied pressure was needed to reach a given density, and higher ejection energy and slightly higher level of stick-slip phenomena were observed (FIG. 10).

TABLE 5

PTC results using ferrous compositions with powdered lubricants, compacted at 45 tsi, and 90° C.

| Lubricants | | In-Die Density g/cm$^3$ | Green Density g/cm$^3$ | Stripping Pressure Tsi | Ejection Unit Energy MJ/m$^3$ |
|---|---|---|---|---|---|
| Ceridust 3620 | Non-oxidized | 7.184 (0.014) | 7.041 (0.015) | 2.81 (0.14) | 20.36 (0.41) |
| Ceridust 3715 | Oxidized | 7.245 (0.005) | 7.108 (0.003) | 2.63 (0.07) | 18.20 (0.20) |
| PE100 | Non-oxidized | 7.177 (0.011) | 7.052 (0.010) | 2.64 (0.01) | 20.08 (0.46) |
| AC307 | Oxidized | 7.212 (0.011) | 7.080 (0.010) | 2.39 (0.06) | 18.58 (0.52) |

EXAMPLE 5

PROPERTIES OF ACUMIST A12 COMPARED TO OTHER CONVENTIONAL LUBRICANTS

An oxidized high density polyethylene lubricant of the invention was tested in comparison with two P/M conventional lubricants, N,N'-ethylenebis(stearamide) wax (EBS) and low density polyethylene. Using conventional dry-mixing blenders, three different powder compositions were prepared containing 98.65 wt. % ATOMET 1001 steel powder (Quebec Metal Powders Ltd.), 0.6 wt. % graphite powder (South Western 1651) and 0.75 wt. % of these three different lubricants in powder form. The oxidized high density polyethylene used as lubricant was the ACumist A-12 described previously. The low-density polyethylene wax lubricant used was the CERACER 640, commercially available from Shamrock Technologies. The weight-average molecular weights of CERACER 640 and Acumist A-12 determined by size exclusion chromatography are −1,500 and −11,000 respectively The third lubricant was the atomized ACRAWAX C from Lonza Inc. (EBS).

Transverse rupture strength (TRS) bars (3.175×1.270×0.635 cm) were compacted at 65° C. and 45 tsi in a floating compaction die, and ejection pressures were recorded for each mixture. Due to the high production rates of metal powder parts encountered in the P/M industry, the die temperature normally increases, then stabilizes, due to the friction between the parts and die walls during the compaction and ejection cycle. A die temperature of 65° C. was chosen to take into account this rise of die temperature. Densities and mechanical strengths (transverse rupture strength according to MPIF 15 Standard) were evaluated. Results are compared in Table 6.

The compaction and ejection characteristics of the three compositions were also evaluated with the instrumented compacting die, known as the Powder Testing Center, described previously. Cylindrical specimens of 9.5 mm diameter and 8.0 mm height were pressed at 45 tsi and 65° C. in a single action compacting die made of H13-steel.

TABLE 6

Results for TRS bars, compacted at 45 tsi and 65° C.

| Lubrcant | ACRAWAX C | CERACER 640 | Acumist A-12 |
|---|---|---|---|
| Green density, g/cm$^3$ | 7.12 | 7.11 | 7.09 |
| Stripping pressure (Ejection peak), tsi | 2.75 | 2.91* | 2.23 |
| Green TRS, psi | 2004 | 3173 | 3261 |

*high level of noise during ejection due to high level of stick-slip

TABLE 7

Results for PTC cylindrical specimens compacted at 45 tsi and 65° C.

| Lubricant | ACRAWAX C | CERACER 640 | ACumist A-12 |
|---|---|---|---|
| Green density, g/cm$^3$ | 7.11 | 7.06 | 7.10 |
| Stripping pressure (Ejection peak), tsi | 2.43 | 3.23 | 1.97 |
| Unit Ejection Energy MJ/m$^3$ | 17.3 | 16.4 | 14.8 |

It has been found in the cold compaction tests that compacts using the oxidized high density polyethylene (oxidized HDPE) lubricant of the invention (ACumist A-12), had similar densities as compacts obtained with conventional EBS lubricant (ACRAWAX C) but higher green strength (3261 psi vs 2004 psi) and better lubricating performance during ejection of parts. TRS bars produced using the low density polyethylene (LDPE) wax lubricant Ceracer 640, described in the prior art, had similar densities and green strengths as those produced with the ACumist A-12 lubricant. PTC results show however that the LDPE lubricant 640 gives rise to a worse lubrication behavior during the ejection of compacted parts From the die, as can be seen on the ejection curve (FIG. 7) with the high level of stick-slip phenomena. This is in agreement with the same observation made by Klemm et al. (1993) paper referred to in the Background of the Invention.

EXAMPLE 6

An oxidized high density polyethylene lubricant (Acumist A12) was tested in comparison with a high density polyethylene (PE190), a conventional synthetic amide wax lubricant (EBS), and a known lubricant for warm compaction, Promold 450, which is a mixture of amide waxes and polyamides. Using conventional dry-mixing blenders, four different powder mixtures were prepared containing 98.65 wt. % ATOMET 1001 steel powder (Quebec Metal Powders Ltd.), 0.6 wt. % graphite powder (South Western 1651) and 0.75 wt. % of the four lubricants. The three first lubricants were already described previously. The PE190 was supplied as a coarse powder, and the fraction below 45 $\mu$m was used in this example. The Promold 450 lubricant was available as a micronized powder from Morton International of Cincinnati, Ohio.

Transverse rupture strength (TRS) bars (3.175×1.270×0.635 cm) were compacted at 130° C. and 45 tsi in a floating compaction die, and ejection pressures were recorded for each mixture. Densities and mechanical strengths (transverse rupture strength according to MPIF 15 Standard) were evaluated. Results are compared in Table 8.

Unlike commercially available P/M lubricants and non-polar high density polyethylene lubricant, this example shows that the oxidized high-density polyethylene lubricant of the invention (ACumist A-12) maintains excellent lubricating properties when the compaction temperature increases and can thus be used favorably for warm compaction applications. Indeed, a low stripping pressure was measured during the ejection of the parts from the die, and parts with a good surface finish were obtained. Besides, oxidized high density polyethylene-lubricated ferrous powder compositions of the invention enable the manufacture by warm compaction of parts having high densities and high green strengths, higher than those expected, compared to ACRAWAX C and PROMOLD 450 lubricants.

TABLE 8

Results for TRS bars, compacted at 45 tsi and 130° C.

| Lubricant | ACRAWAX C | PROMOLD 450 | PE 190 | ACumist A-12 |
|---|---|---|---|---|
| Green density, g/cc | 7.21 | 7.24 | 7.24 | 7.24 |
| Stripping pressure (Ejection peak), tsi | 2.09* | 2.28 | 2.24* | 1.85 |

TABLE 8-continued

Results for TRS bars, compacted at 45 tsi and 130° C.

| Lubricant | ACRAWAX C | PROMOLD 450 | PE 190 | ACumist A-12 |
|---|---|---|---|---|
| Green TRS, psi | 2605 | 3058 | 5767 | 5645 |

*high level of noise during ejection

EXAMPLE 7

EFFECT OF HEAT TREATMENT ON THE PROPERTIES OF THE COMPOSITIONS

Two powder compositions were prepared by dry mixing in conventional blender 98.65 wt. % ATOMET 1001 steel powder (Quebec Metal Powders Ltd.), 0.6 wt. % graphite powder (South Western 1651) and 0.65 wt. % of lubricant. The first lubricant is the oxidized high density polyethylene Acumist 12. The second lubricant is a conventional synthetic amide wax lubricant (EBS), ACRAWAX C from Lonza Inc.

Rectangular bars (3.175×1.270×0.635 cm) were pressed to densities of 7.0 g/cm$_3$ at 65° C. in a floating compaction die. Some parts were heat treated in air at 225° C. during 1 hour. Transverse rupture strengths were evaluated according to MPIF 15 Standard. Results are compared in Table 9.

TABLE 8

Results for TRS bars, compacted to 7.0 g/cc and 45° C.

| Lubricant | Heat treatment | ACRAWAX C | ACumist A-12 |
|---|---|---|---|
| Green TRS, psi | No | 2400 | 3380 |
| | Yes | 2800 | 8580 |

The results show that higher green strength is obtained with the oxidized high density polyethylene of the invention as compared to the conventional synthetic amide Acrawax C. It is worth mentioning however that this property may significantly increase from 3330 psi to 8580 psi by heat-treating the specimens, before the sintering step, at a low temperature above the melting point of the lubricant. This enhancement of green strength of compacted parts by using a thermal treatment is not observed with the conventional lubricant Acrawax C. One explanation, suggested by Tremblay et al. [L. Tremblay, Y. Thomas, "*Enhanced Green Strength Lubricating Systems for Green Machining Ferrous Materials*", Advances in Powder Metallurgy & Particulate Materials, MPIF, 1999. Vol. 1, 2.141–2,156.1], may be that the lubricant of the invention above its melting point flow into the porosity during the thermal treatment and forms a network of lubricant sufficiently strong to enhance the green strength. In the case of Acrawax C, it can be assumed that it only tends to form a thin low strength lubricating film around the metal particles during the thermal treatment.

The above examples use ferrous powder compositions. It is however reasonable to conclude, considering the properties of various metals, that the lubricant proposed herein is applicable for other metal powder compositions, the metal being one or more of the metals typically used in powder metallurgy.

What is claimed is:

1. A metallurgical powder composition for cold or warm compaction, comprising a metal powder admixed with lubricant containing oxidized high density polyethylene.

2. A metallurgical powder composition as claimed in claim 1, wherein said oxidized high density polyethylene has a weight-average molecular weight between 1,000 and 50,000.

3. A metal powder composition comprising a ferrous powder and from about 0.1 to about 3 wt. % of an oxidized high-density polyethylene lubricant based on the total weight of the composition.

4. The composition according to claim 3 wherein said oxidized high-density polyethylene lubricant has a weight-average molecular weight between 1,000 and 50,000.

5. The composition according to claim 3 wherein the content of said lubricant is from about 0.2 wt. % to about 1.5 wt. %.

6. The composition according to claim 3 wherein said lubricant is admixed to the metal powder in a commuted solid state.

7. The composition according to claim 3 further comprising alloying powders in the amount of less than 15 weight percent of said composition.

8. The composition according to claim 4 wherein said oxidized high density polyethylene lubricant has a weight-average molecular weight between 2,000 and 20,000.

9. The composition according to claim 3 wherein said lubricant is admixed to the metal powder in the form of an emulsion or a solution.

10. The composition according to claim 3 wherein said lubricant is admixed to the metal powder in a molten state.

11. The composition according to claim 3 further comprising one or more solid lubricants either mixed separately or as a single-phase.

12. The composition according to claim 3 further comprising one or more additives such as binders.

13. In a process for compacting a metallurgical powder composition, the improvement wherein a metal powder is associated with a lubricant containing oxidized high density polyethylene.

14. A process as claimed in claim 13, wherein said oxidized high density polyethylene has a weight-average molecular weight between 1,000 and 50,000.

15. A process as claimed in claim 13, wherein said lubricant is applied to a die used for compacting the metallurgical powder composition so that said lubricant contacts said metallurgical powder composition during compaction.

16. A process as claimed in claim 15, wherein said lubricant is applied to the die by electrostatic spraying.

17. A process as claimed in claim 13, wherein said lubricant is admixed with said metallurgical powder composition prior to compaction.

18. A process as claimed in claim 13, wherein said compaction is warm compaction.

19. A process as claimed in claim 13, wherein said compaction is cold compaction.

* * * * *